US005494485A

United States Patent [19]

Gabion et al.

[11] Patent Number: 5,494,485

[45] Date of Patent: Feb. 27, 1996

[54] EPILATING APPLIANCE WITH FORCE ADJUSTING PINCERS

[75] Inventors: Georges Gabion; Aimé Cleyet; Robert Roger, all of Lyons, France

[73] Assignee: Braun Aktiengesellschaft, Kronberg, Germany

[21] Appl. No.: 203,982

[22] Filed: Feb. 18, 1994

[51] Int. Cl.[6] ..... A45D 26/00

[52] U.S. Cl. ..... 606/133; 606/131

[58] Field of Search ..... 452/71, 82–86; 606/131, 133

[56] References Cited

U.S. PATENT DOCUMENTS

| | | | |
|---|---|---|---|
| 1,923,415 | 8/1933 | Bingham | 452/84 |
| 5,041,123 | 8/1991 | Oliveau et al. | 606/133 |
| 5,112,341 | 5/1992 | Doley | 606/131 |
| 5,207,689 | 5/1993 | Demeester | 606/133 |

FOREIGN PATENT DOCUMENTS

| | | | |
|---|---|---|---|
| 0328426 | 8/1989 | European Pat. Off. . | |
| 0403315 | 12/1990 | European Pat. Off. . | |
| 0532106 | 3/1993 | European Pat. Off. | 606/133 |
| 1032138 | 2/1951 | France . | |

*Primary Examiner*—Stephen C. Pellegrino
*Assistant Examiner*—Glenn Dawson
*Attorney, Agent, or Firm*—Fish & Richardson

[57] ABSTRACT

An epilating appliance for the removal of human body hair, with a casing adapted to be held in the user's hand, with a rotary cylinder including pincer elements driven by a motor. At least one actuator element extends through the rotary cylinder for actuating the pincer elements coupled thereto. The actuator element being operable by an associated pressure element and being displaceable against the pressure of a spring, wherein structure is provided for adjusting the gripping force of the pincer elements.

38 Claims, 8 Drawing Sheets

EPILATING APPLIANCE WITH FORCE ADJUSTING PINCERS

This invention relates to an epilating appliance for the removal of human body hair, with a casing adapted to be held in the user's hand, with a rotary cylinder including pincer elements and driven by a motor, and with at least one actuator element extending through the rotary cylinder for actuating the pincer elements coupled thereto, with the actuator element being operable by an associated pressure element and being displaceable against the pressure of a spring.

An epilating appliance of the type initially referred to is known from U.S. Pat. No. 5,207,689. The rotary cylinder which is adapted to be rotated by a rotary shaft is comprised of pivotally mounted pincer blades caused to perform pivotal movements by actuating rods extending through the rotary cylinder. In diametrically opposite arrangement on the shaft are two actuating-rod units producing gripping actions on each half revolution of the rotary cylinder. Each actuating-rod unit is comprised of two relatively associated actuating rods which are acted upon at their respective ends once per revolution by a respective roller rotatably mounted on a bar fixedly disposed in the epilation head, performing reciprocating movements in opposite directions against the pressure of a common spring. The relatively associated actuating rods transmit this movement to the pincer blades which pivot towards each other in pairs, being finally pressed into contact with each other in the area of their outer edges.

The two rollers acting on the actuating rods are each rotatably secured to the epilation head at a predetermined relative distance by means of a respective bar. Because reasons of manufacture do not allow this distance to be maintained accurately, the gripping force of the pincer blades at the gripping location is subject to considerable fluctuations. When the gripping force is too high, the relatively thin hairs are pinched off, and when it is too weak, the hairs are not gripped sufficiently, preventing them from being extracted from the skin. An added disadvantage is the wear occurring on both the rollers and the actuating rods in the use of the epilating appliance due to friction and material fatigue, for example.

Another epilating appliance of the type initially referred to is known from U.S. Pat. No. 5,041,123. The rotary cylinder of this epilating appliance is comprised of stationary pincer elements and pivotal pincer elements operatively associated therewith. The stationary pincer elements are a component part of a rotary shaft. Two diametrically opposed actuating rods extend through the rotary cylinder for the purpose of actuating the respective row of pincer elements. A roller rotatably mounted on a bar which is fixedly disposed in the epilation head acts upon each of the actuating rods once per revolution of the rotary cylinder either directly or indirectly through the intermediary of a specially configured pivot bearing, with the return stroke of the respective actuating rod being accomplished by means of a spring acting on it at its end remote from the roller.

It is an object of the present invention to improve the plucking of hair using an epilating appliance of the aforesaid type.

According to the present invention, this object is accomplished in an epilating appliance of the type set forth above in that means for adjusting the gripping force of the pincer elements are provided.

In an embodiment of the present invention, the position of the actuator element is variable by means of an adjusting device.

In a further embodiment of the present invention, the relative position of actuator elements cooperating in pairs is variable by means of an adjusting device.

The variation of the position of an actuator element provided with pincer elements relative to a pressure element associated with the actuator element by means of an adjusting device results in an increased gripping force of the cooperating pincer elements when the relative distance is diminished, and in a reduced gripping force when the relative distance is increased. An adjusting device that acts on the actuator elements of pincer elements directly or indirectly will accordingly ensure an optimum adjustment of the gripping force of cooperating pincer elements of an epilating appliance by the manufacturer who may compensate for manufacturing tolerances, for example, and also by the user who may adapt the gripping force to her individual requirements depending on the thickness of her hair and moreover, may correct a wearrelated slackening of the gripping force by performing a re-adjustment.

In an embodiment of the present invention, the pressure element acting on the actuator element is configured as an adjustable eccentric.

In order to reduce the friction between the pressure element and the actuator element, the pressure element acting on the actuator element is configured as a roller and is rotatably mounted on an adjustable eccentric.

In a further feature of the present invention, the contact surfaces of the pressure element and the actuator element acting upon each other directly or indirectly are arranged so as to extend at right angles and/or in wedge shape to each other.

In order to reduce operating noise and wear, a disc is provided between the pressure element and the actuator element.

In an embodiment of the present invention, the position of the pressure element is adjustable by means of an adjusting nut acting on the pressure element.

In a preferred embodiment of the present invention, the eccentric and/or the roller are arranged on a bar fixedly disposed in the epilation head.

In another embodiment of the present invention, the eccentric and/or the roller are arranged on a bar adjustably disposed in the epilation head.

In a still further embodiment of the present invention, the bar is formed of a straight pin.

The bar is preferably configured as a U-shaped bracket.

The arrangement of one or several pressure elements on bars fixedly or adjustably disposed in the epilation head for the purpose of actuating the actuator elements associated therewith admits of a plurality of different configurations of the adjusting device for adjusting the gripping force of the pincer elements coupled to the actuator elements. A substantial advantage of the details is the capability to adapt to the various configurations of a rotary cylinder and its mounting in the epilation head.

In a further feature of the present invention, abutments are associated with the lateral arms of the bracket, with the position of the lateral arms relative to the abutments being variable by means of a further adjusting device. Varying the relative position of the lateral arms to the abutments which are formed by the axle ends has an effect on the bias of the bracket. The bias of the bracket is used for varying the relative distance of the pressure elements and thereby the length of travel under the action of the gripping force, that is, the distance traveled by the actuator elements and the pressure elements when in mutual contact. As this distance becomes longer, more power will be required for operating the epilating appliance. A reduced distance will result in lower power requirements.

Advantageously, the adjusting device is configured as an adjustable eccentric enabling the position of the lateral arms to be varied continuously.

In an embodiment of the present invention, the eccentric is coupled to the eccentric that varies the relative distance of the pressure elements acting on the actuator elements. By adjusting one of the eccentrics, preferably the first eccentric, by means of the adjusting device coupled thereto, two different functions can be performed at the same time.

Because the eccentrics are integrally made of one piece, that is, they are provided on a component part, the variation of the relative distance of the pressure elements by adjusting the first eccentric results at the same time in a variation of the relative positions of the lateral arms to the abutments by means of the second eccentric. If the maximum possible adjusting stroke of the eccentric, that is, the maximum gripping force, is adjusted in the process, the bracket is at the same time biased to its maximum. As a result of this increased bias, in the gripping position the length of travel to be covered by the actuator elements when in contact with the pressure elements and thus under the action of the gripping force is shortened, whereby the power requirements of the epilating appliance are reduced.

Further advantages and details of the present invention will become apparent from the subsequent description and the accompanying drawings illustrating some preferred embodiments.

In the drawings,

FIG. 1 is a view, partially in section, of an epilating appliance showing a detachable epilation head;

FIG. 1*a* is a detail view of the adjusting device of FIG. 1;

Figure 5:
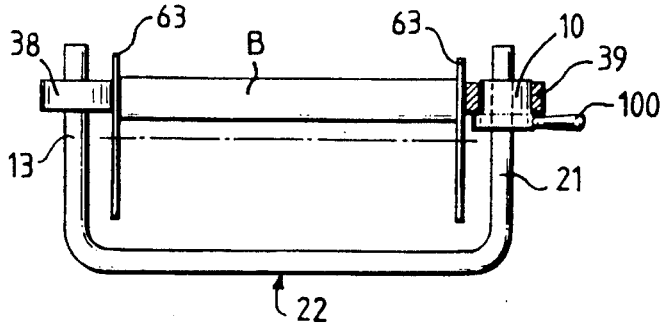
FIG. 5 is a schematic representation of the components of an adjusting device provided with an eccentric.
Figure 5A:
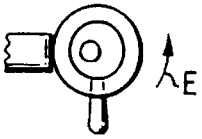
Figure 5B:
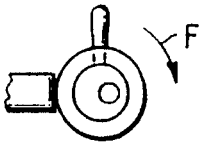
Figure 6:
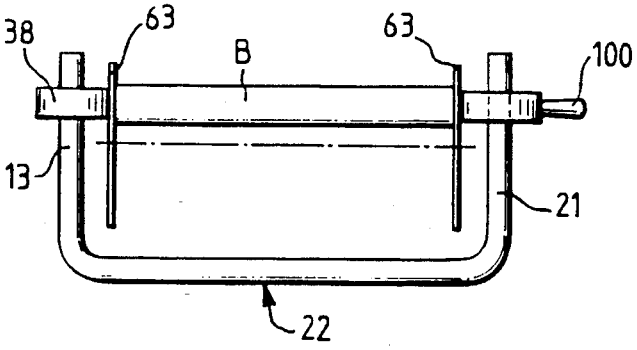
Figure 7A:
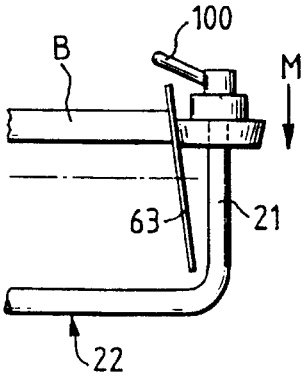
Figure 7B:
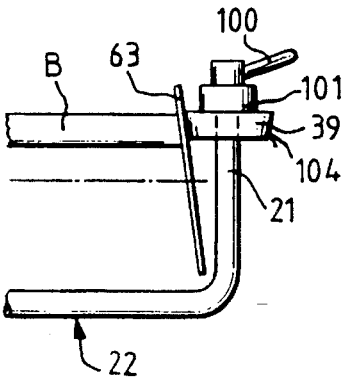
Figure 7:
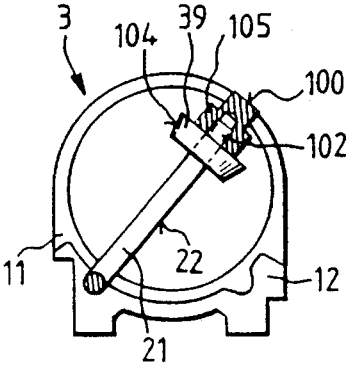
Figure 8:
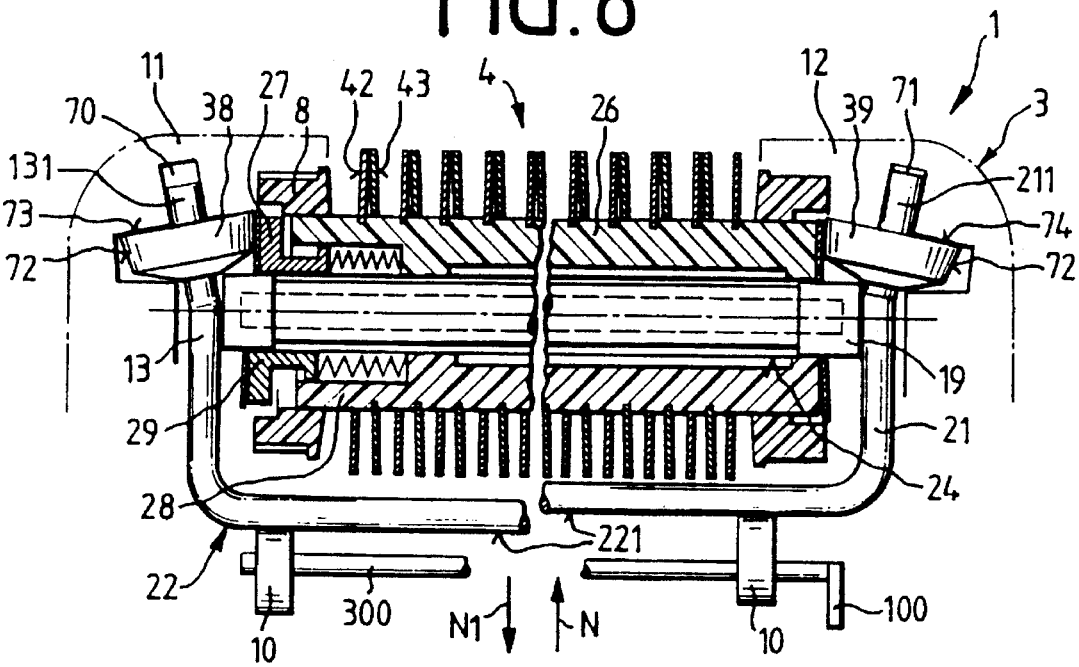
Figure 8A:
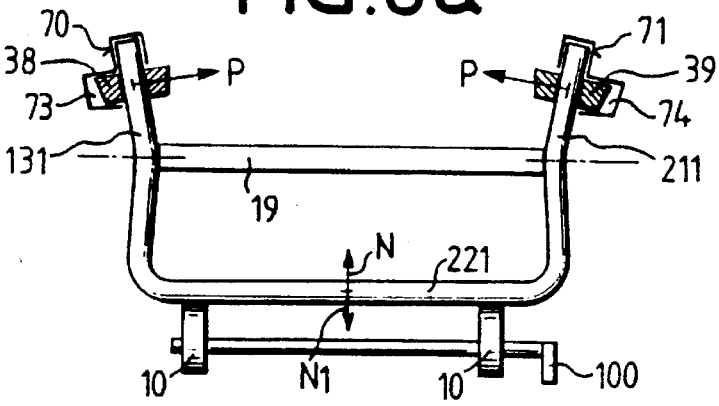
Figure 8B:
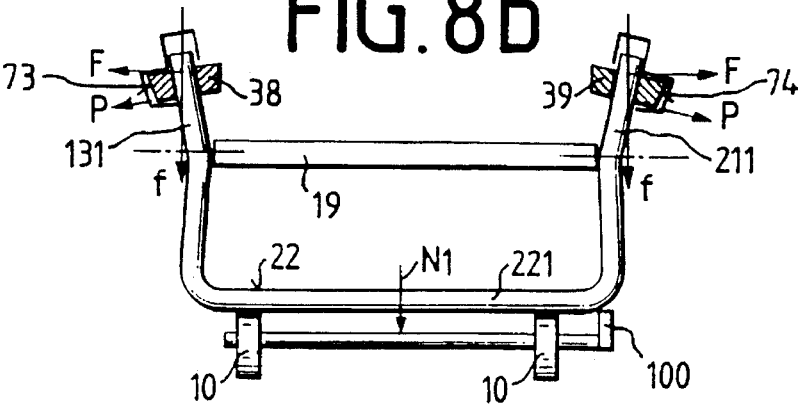
Figure 9:
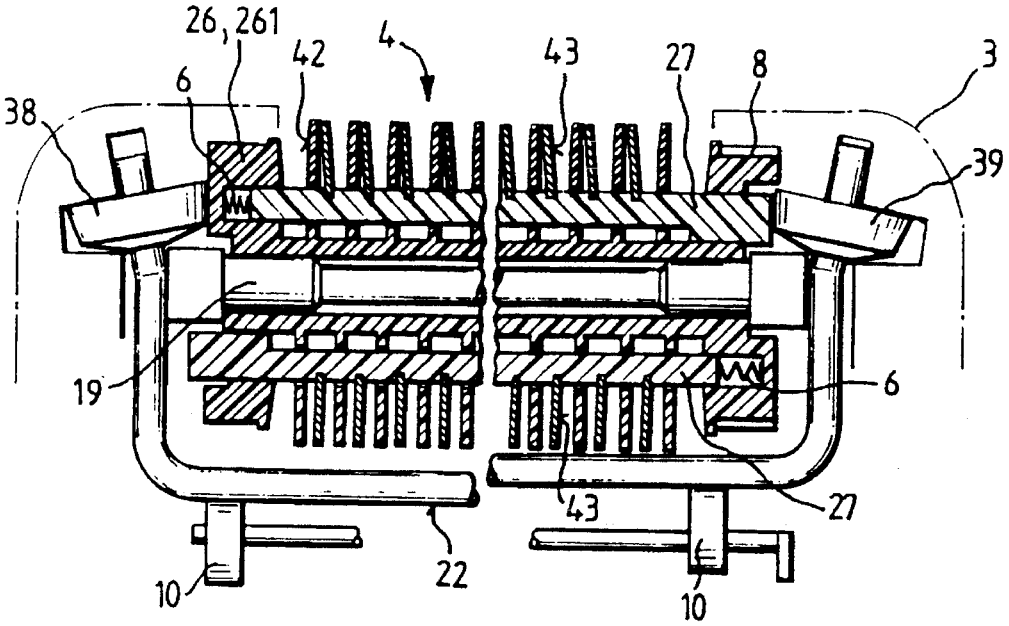
Figure 12:
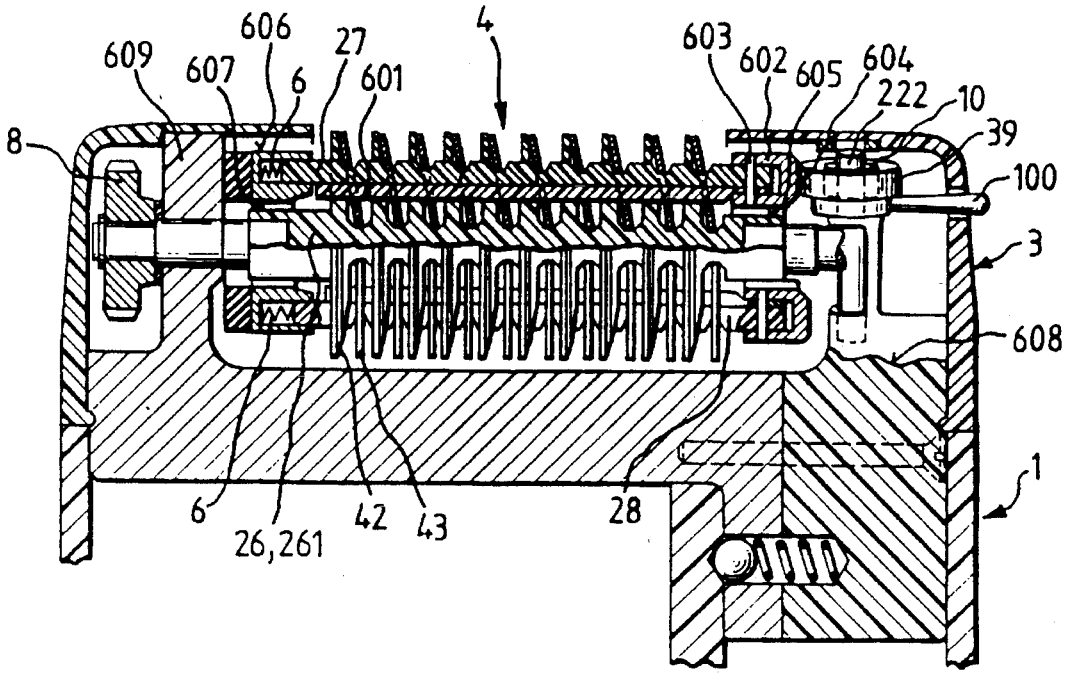
Figure 10:
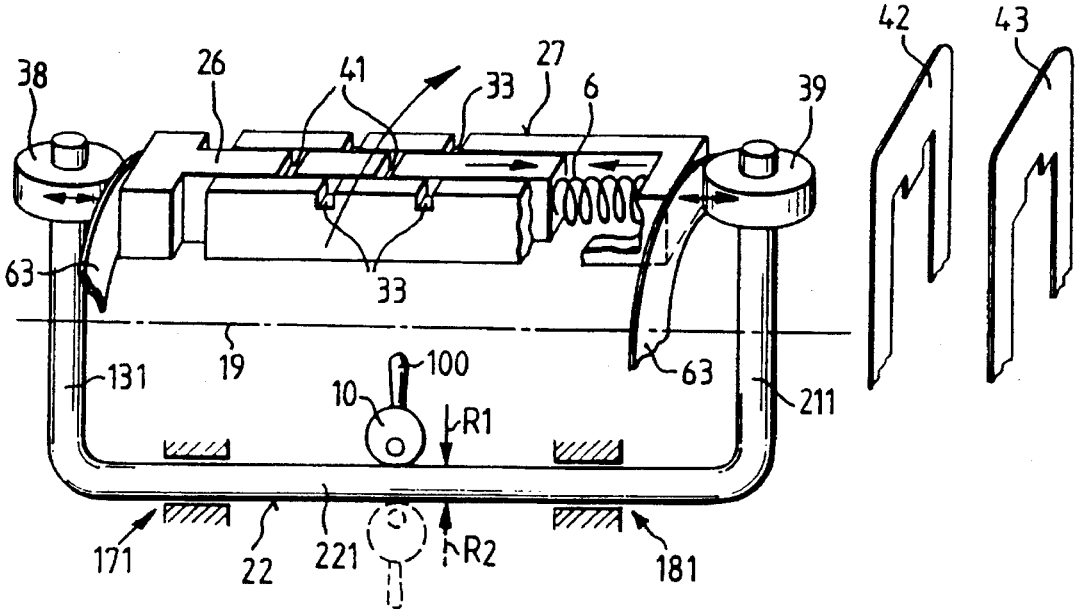
Figure 11:
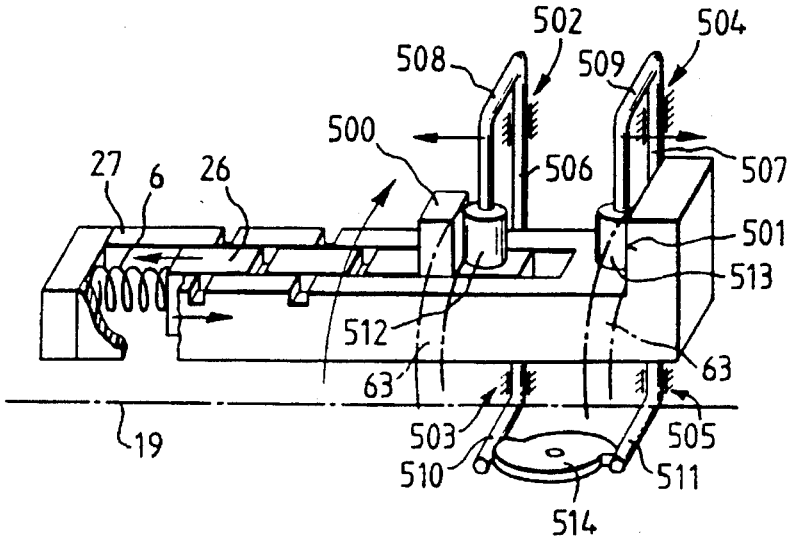
Figure 11A:
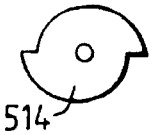
Figure 13:
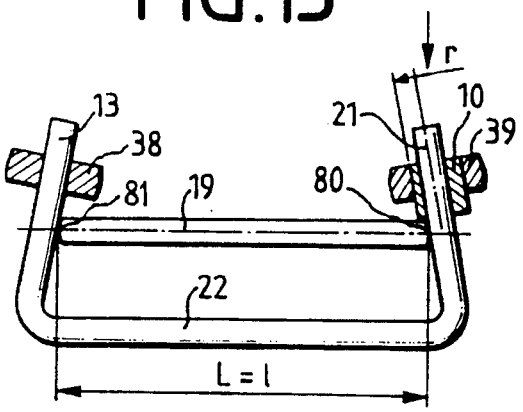
Figure 14:
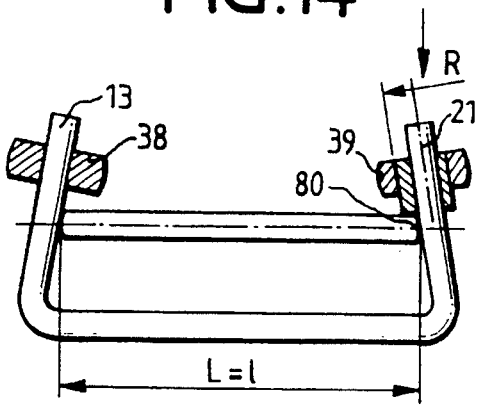
Figure 13A:
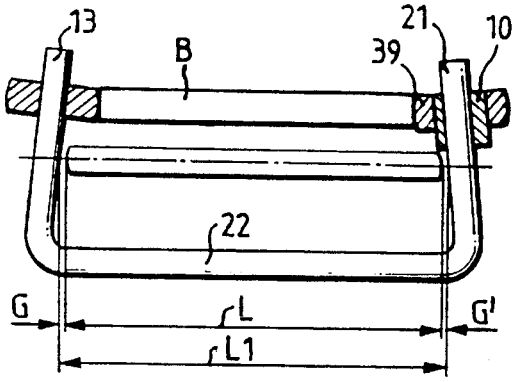
Figure 14A:
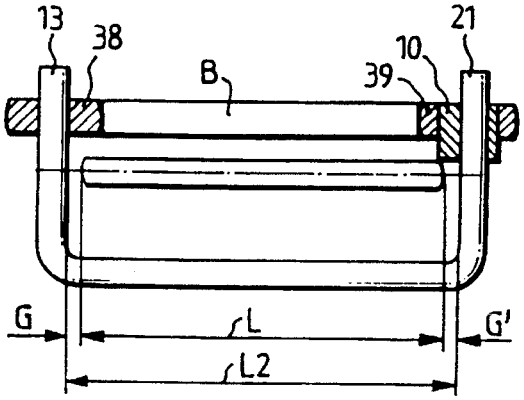
Figure 13B:
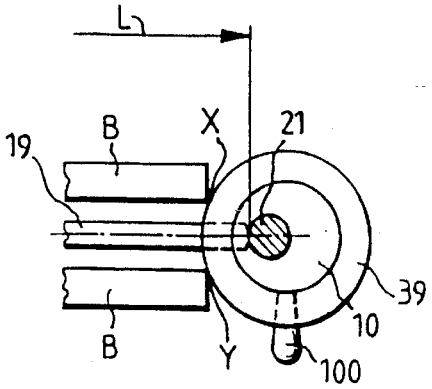
Figure 14B:
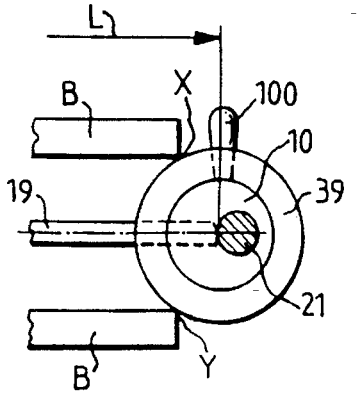
Figure 15:
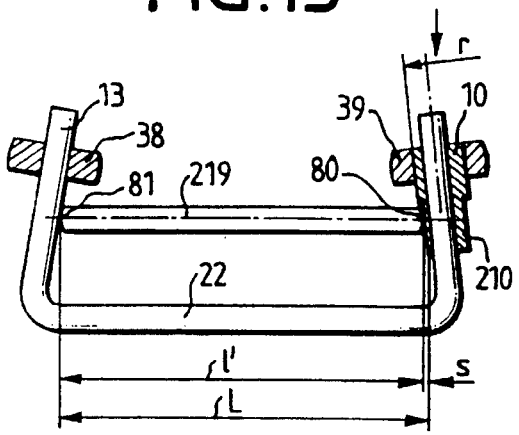
Figure 16:
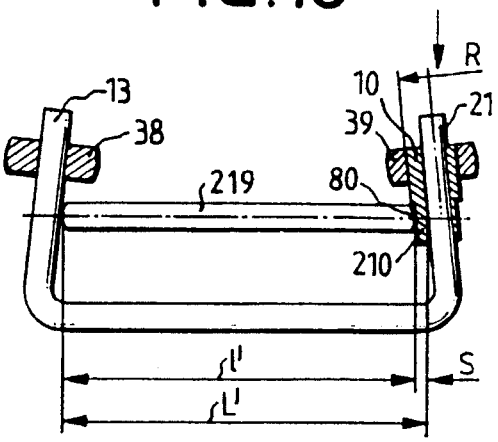
Figure 15A:
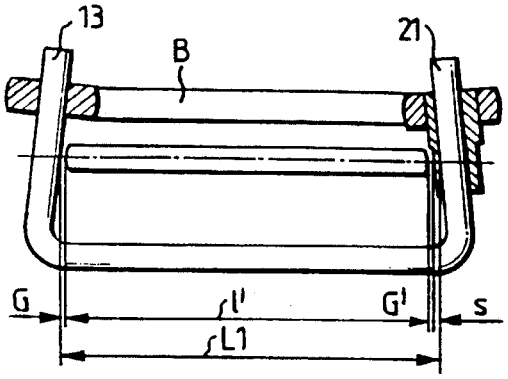
Figure 16A:
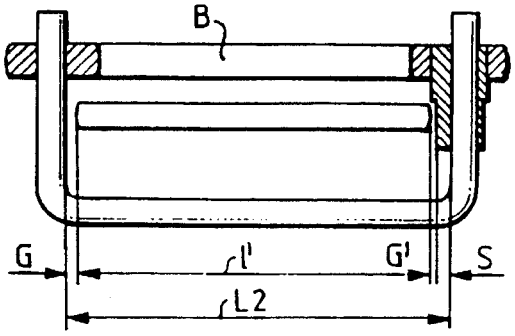
Figure 15B:
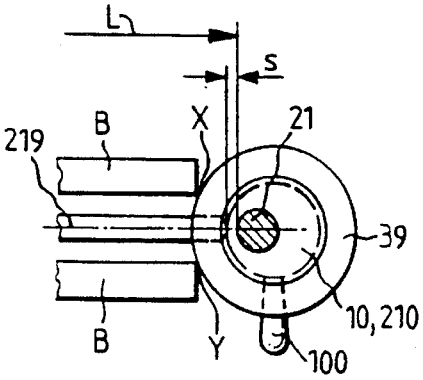
Figure 16B:
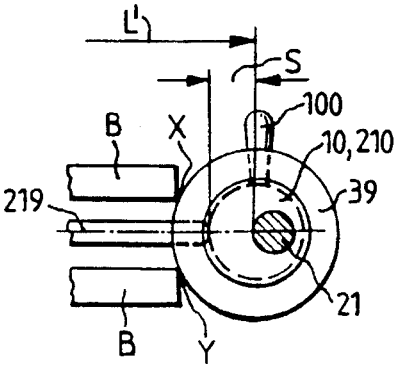

FIG. 5*a* shows the position of the eccentric with the pressure element of FIG. 5 when the adjusting stroke is at a minimum;

FIG. 5*b* shows the position of the eccentric with the pressure element of FIG. 5 when the adjusting stroke is at a maximum;

FIG. 6 is a schematic representation of the components of a further adjusting device provided with an eccentric;

FIG. 7 is a sectional view of an epilation head with a bracket fixedly disposed in the epilation head, illustrating a further embodiment of an adjusting device;

FIG. 7*a* shows the position of the pressure element of FIG. 7 when the adjusting stroke is at a maximum;

FIG. 7*b* shows the position of the pressure element of FIG. 7 when the adjusting stroke is at a minimum;

FIG. 8 is a sectional view of an epilation head showing parts of a further adjusting device, with the bracket being displaceably mounted within the epilation head;

FIG. 8*a* is a schematic representation of the function of the adjusting device of FIG. 8, showing the pressure elements at a minimum relative distance;

FIG. 8*b* is a schematic representation of the function of the adjusting device of FIG. 8, showing the pressure elements at a maximum relative distance;

FIG. 9 is a sectional view of an epilation head including an adjusting device of FIGS. 8, 8*a*, 8*b* and a rotary cylinder whose rotary component incorporating pincer elements is associated with at least one actuator element provided with pincer elements;

FIG. 10 is a schematic representation of a further embodiment of an adjusting device including a bracket fixedly disposed in the epilation head;

FIG. 11 is a schematic representation of a further embodiment of an adjusting device including two brackets rotatably arranged within the epilation head and a cam for adjusting the gripping force;

FIG. 11*a* is a top plan view of the cam of FIG. 11;

FIG. 12 is a sectional view of an epilation head, including a rotary component having fixed pincer elements and two actuator elements having movable pincer elements, and an adjusting device acting on the actuator elements;

FIG. 13 is a schematic representation of the effect of an adjusting device including one eccentric, when the adjusting stroke is at a minimum and the pincer elements are in the open position;

FIG. 13*a* is a schematic representation of the adjusting device of FIG. 13 in the gripping position;

FIG. 13*b* is a top plan view of the adjusting device of FIG. 13;

FIG. 14 is a schematic representation of the effect of the adjusting device including one eccentric, when the adjusting stroke is at a maximum and the pincer elements are in the open position;

FIG. 14*a* is a schematic representation of the adjusting device of FIG. 14 in the gripping position;

FIG. 14*b* is a top plan view of the adjusting device of FIG. 14;

FIG. 15 is a schematic representation of the effect of an adjusting device including two eccentrics, when the adjusting stroke of the first and the second eccentric is at a minimum and the pincer elements are in the open position;

FIG. 15*a* is a schematic representation of the adjusting device of FIG. 15 in the gripping position;

FIG. 15*b* is a top plan view of the adjusting device of FIG. 15;

FIG. 16 is a schematic representation of the effect of the adjusting device including two eccentrics, when the adjusting stroke of the first and the second eccentric is at a maximum and the pincer elements are in the open position;

FIG. 16*a* is a schematic representation of the adjusting device of FIG. 16 in the gripping position; and FIG. 16*b* is a top plan view of the adjusting device of FIG. 16.

Figure 1A:
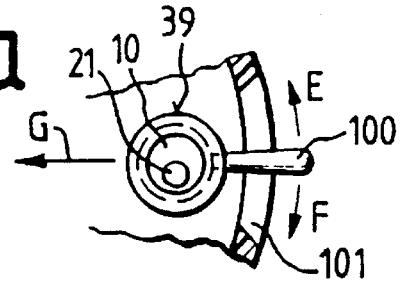
Figure 1:
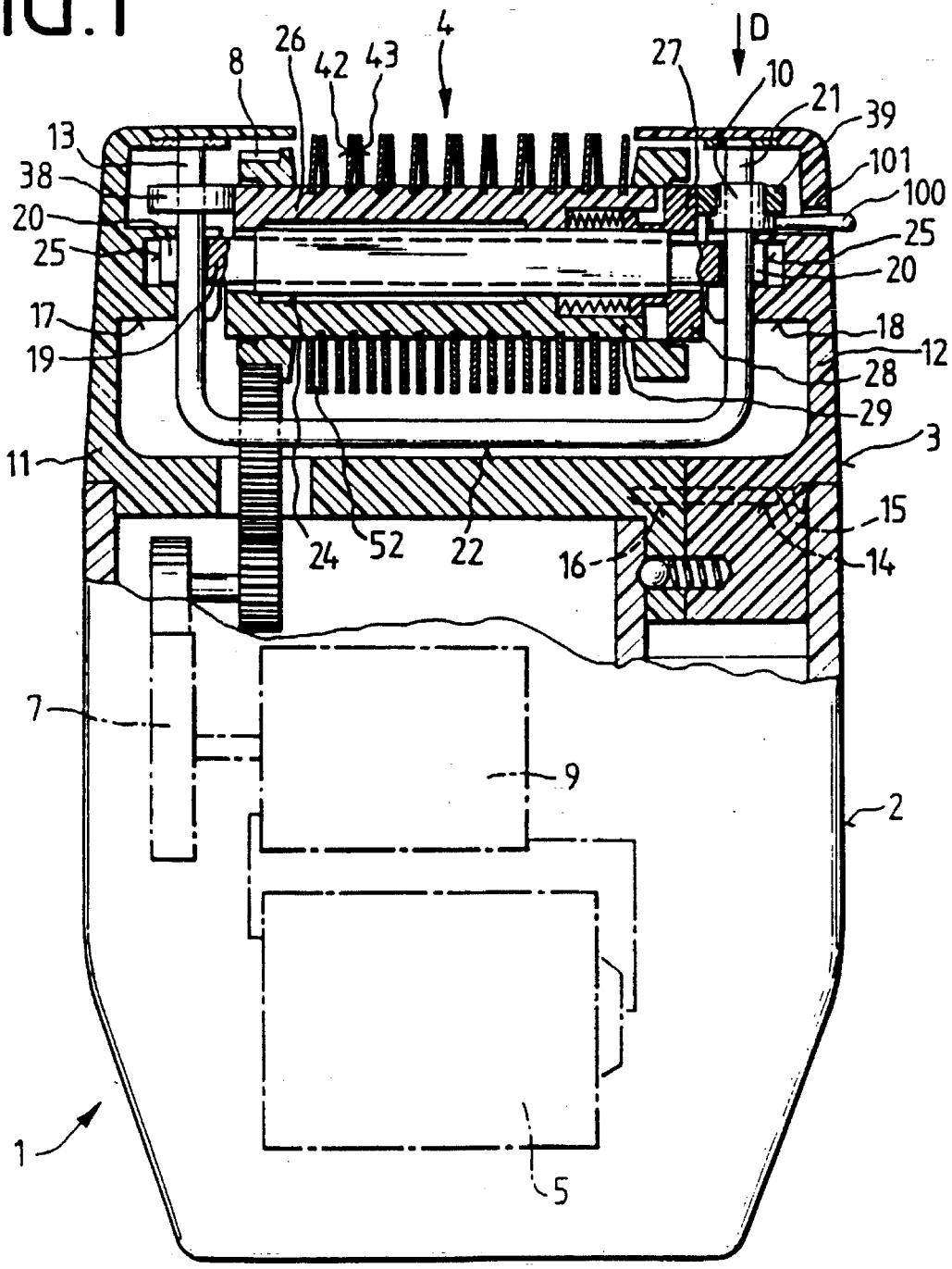

In FIG. 1 of the drawings, reference numeral 1 designates an appliance for the removal of human body hairs, that is, an epilating appliance, shown partially in section, which is comprised of a casing 2 and a detachable epilation head 3 for receiving a rotary cylinder mounted so as to be drivable.

The rotary cylinder 4 is driven by an electric drive motor 9 which is adapted to be connected to a power line or to a rechargeable accumulator 5 or an exchangeable battery pack.

The drive motor 9 is in driving relationship with a driving gear 8 of the rotary cylinder 4 through a gear train 7 comprising a plurality of gears.

The epilation head 3 which is detachably secured to the casing 2 by means of a ball engaging within a notch and acted upon by a spring includes a left-hand bearing shell 11 which is detachably connected to a right-hand bearing shell 12 and is secured by a screw 15 extending to this end through a bore 14 in the bearing shell 12 to be received in a tapped hole 16 provided in the bearing shell 11.

The bearing shells 11 and 12 accommodate a respective bearing bush 17 and 18 to carry the lateral arms 13, 21 of a bracket 22 and the journal 25 of an axle 19 on which the rotary cylinder 4 is rotatably mounted. At either end of the axle 19, a respective slotted opening 20 is provided having extending therethrough a respective lateral arm 13, 21 of the bracket 22 shown in side view.

At the upper ends of the lateral arms 13, 21, a respective pressure element 38, 39 is provided which serves the purpose of acting on the actuator elements 26, 27 and 28, 29 contacting the pressure elements in the course of rotation of the rotary cylinder, the actuator elements being coupled to pincer elements 42, 43. While the pressure element 38 is rotatably mounted directly on the lateral arm 13, the opposite pressure element 39 is rotatably mounted on an eccentric 10 rotatably embracing the lateral arm 21. The eccentric 10 is provided with an adjusting lever 100 passed through an opening 101 in the epilation head 3 in order to enable the user of the epilating appliance to adjust the eccentric 10.

FIG. 1*a* shows the adjusting device of FIG. 1 as viewed in the direction of the arrow D. The adjusting lever 100 of the eccentric 10 rotatably mounted on the lateral arm 21 and rotatably receiving the pressure element 39 is in a neutral position within the opening 101. By turning the adjusting lever 100 in the direction of arrow E, the pressure element 39 will be moved through the eccentric in the direction of arrow G, and when it is turned in the direction of arrow F, it will be moved in the opposite direction, the eccentric stroke being determined by the predetermined eccentricity of the eccentric 10 and the predetermined adjusting range of the eccentric 10 in the direction of arrows E and F, starting from the neutral position illustrated.

Details of the embodiment of the rotary cylinder shown in FIG. 1 will be set out in the following with reference to FIGS. 2, 3 and 4. The rotary cylinder 4 is rotatably mounted on the axle 19 by means of a horizontally extending bearing structure 24. The bearing structure 24 is coupled in driving relationship to the driving gear 8 of the gear train.

Two pairs of actuator elements 26, 27 and 28, 29 capable of being telescoped together are mounted on the upper and, respectively, diametrically opposite lower side of the bearing structure 24.

Figure 4:
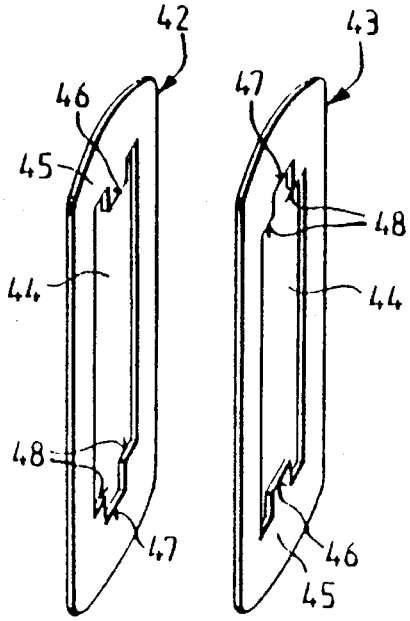
FIG. 4 is a perspective view of pincer elements cooperating in pairs, illustrating an embodiment thereof.

Pincer elements 42 and 43 illustrated in FIGS. 1 and 4 are disposed on the actuator elements 26 to 29, being connected to them in a driving relationship. A plurality of pincer elements 42, 43 cooperate in pairs, each pair forming a tweezing device for the removal of human body hair. The tweezing device is part of the rotary cylinder 4.

Figure 3:
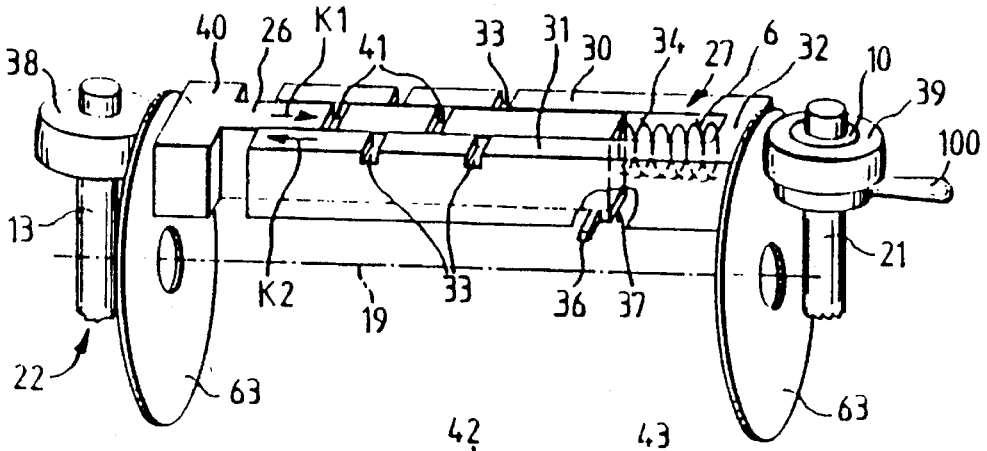
FIG. 3 is a perspective view of components of a rotary cylinder and of an adjusting device.

The two upper actuator elements 26, 27 are illustrated in FIG. 3 in perspective view. The one actuator element 27 is of a U-shaped configuration including parallel legs 30, 31 interconnected at their one end by a cross-member 32. The upper side of the two parallel legs 30, 31 is provided with a plurality of equidistantly spaced slots 33 forming a right angle with a respective longitudinal side of the legs 30, 31. The slots 33 of the actuator element 27 lie on the same transverse plane as the slots 41 of the adjacent actuator element 26.

The two parallel legs 30, 31 provide a U-shaped recess 34 in which the actuator element 26 is axially slidably received. According to FIG. 3, a spring 6 normally holding the actuator element 26 in a neutral position relative to the actuator element 27 is disposed between the right-hand end of the actuator element 26 and the cross-member 32. In the position illustrated in FIG. 3, the actuator element 26 is urged with a stop 37 provided at its one end into abutment with a transversely extending stop 36 provided in the lower area of the two legs 30, 31 of the actuator element 27, establishing a connection between the actuator elements. This prevents the actuator element 26 from being pushed out of its engagement with the recess 34.

As becomes apparent from FIG. 1 and FIG. 3, a respective pressure element 38 and 39 is provided on the lateral arms 13, 21 of the U-shaped bracket 22. In the position illustrated in FIG. 3, rotation of the rotary cylinder will cause the pressure elements 38 and 39 to telescope the actuator elements 26 and 27 together against the action of the spring 6, when the respective cross-members 32 and 40 are moved past the pressure elements 38 and 39.

In this actuating process, the actuator element 26 with the slots 41 provided therein will be displaced to the right, while the actuator element 27 with its slots 33 will be displaced to the left. As this occurs, the pincer elements 42, 43 pivotally mounted within the slots 33, 41 will move into engagement with each other in pairs at their respective ends remote from the axle 19.

In FIG. 3, a disc 63 is additionally inserted between the pressure elements 38, 39 and the respective ends of the actuator elements 26 and 27, causing the pressure elements 38, 39 to act upon the actuator elements 26, 27 through the intermediary of the respective disc 63 as a result of which operating noise and wear are reduced.

The pressure element 39 is rotatably mounted on the eccentric 10. The eccentric 10 which is provided with an adjusting lever 100 is adjustably disposed on the lateral arm 21 of the bracket 22 and produces, through a movement of the adjusting lever 100, a decrease or an increase in the relative distance of the two opposite pressure elements 38 and 39, consequently adjusting the gripping force of the pincer elements 42 and 43 disposed on the actuator elements 26, 27, 28, 29.

In FIG. 4, two pincer elements 42 and 43 normally lying closely adjacent to each other are shown. The left and right pincer elements 42, 43 have each a rectangular cutout 44. A downwardly extending nose 46 is provided at the top end 45 of, the cutout 44 of the left-hand pincer element 42. In addition, an upwardly open recess 47 is provided at the bottom end of the cutout 44 of the left-hand pincer element 42.

The right-hand pincer element 43 when viewing FIG. 4 is of the same shape as the pincer element 42. It is shown in a position turned through 180° relative to the pincer element 42, that is, a recess 47 is provided at the top end, while the nose 46 is at the bottom end of the pincer element 43.

A plurality of adjacent pincer elements 42, 43 combine with the remaining components to provide a device for the removal of human body hair.

Figure 2:
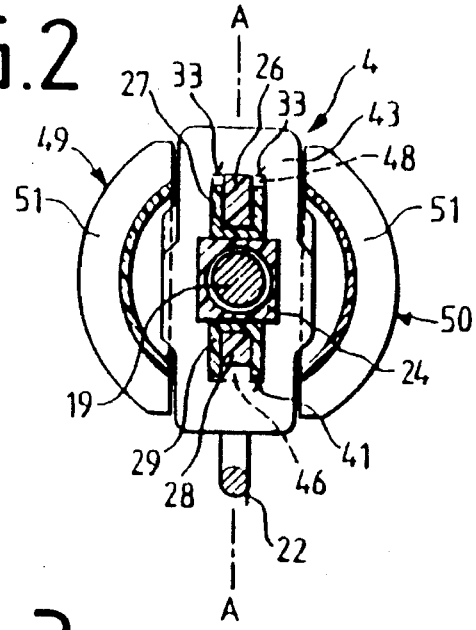
FIG. 2 is a sectional view of a rotary cylinder of FIG. 1.

To accomplish this, the pincer elements are mounted on the upper actuator elements 26, 27 shown in FIG. 3 as well as on the lower actuator elements 28, 29 shown in FIG. 2. For mounting, the upper noses 46 of the pincer elements 42 engage into respective slots 41 of the center actuator element 26, while engaging means 48 bounding the recess 47 engage into the respective opposite slots 33 of the two parallel legs 30, 31.

The mounting is similar with the bottom portions of the pincer elements 42, 43. The two engaging means 48 of the pincer element 42 engage into the slots 33 of the two outer legs 30, 31, so that each pincer element 42 is coupled in driving relationship to the center actuator element 26 by means of the upper nose 46 on the one part, and to the outer legs 30, 31 of the U-shaped actuator element 29 by the two lower engaging means 48 on the other part.

FIG. 2 illustrates, in section, how the individual pincer elements 42 and 43 are coupled in a driving relationship to the upper actuator elements 26, 27 and the lower actuator elements 28, 29. The upper engaging means 48 of the pincer element 43 engage in the two opposite slots 33 of the actuator element 27, while the nose 46 of the same pincer element 43 engages in the slot 41 of the center actuator element 28.

As becomes further apparent from FIG. 2, two threading aids 49, 50 configured in shell shape are arranged to the right and left of, at positions and above and below, a plurality of adjacent pincer elements 42 and 43, the threading aids having a plurality of adjacent parallel laminae 51 which serve the function of raising the body hairs such as to introduce them readily into the space 52 between two cooperating pincer elements 42, 43 (FIG. 1).

The threading aids 49, 50 are arranged on, and removably attached to, the bearing structure 24 surrounding the axle 19. The mode of operation of the epilating appliance will be explained in greater detail with reference to FIGS. 1 to 4. In the course of rotation of the rotary cylinder 4 rotatably mounted on the axle 19 by means of the bearing structure 24, the respective ends of the cross-members 32, 40 of the actuator elements 26, 27 and 28, 29 will move into abutment with the pressure elements 38, 39, the actuator elements sliding on the bearing structure 24 in opposed directions indicated by arrows $K_1$ and $K_2$ against the pressure of the common spring 6, in accordance with the relative distance of the pressure elements 38, 39. The pincer elements 42 and 43 movably disposed within the slots 33 and 41 and forming a pair of tweezers will execute a movement towards each other, gripping, trapping and finally extracting the hair introduced therebetween from the skin as the rotary cylinder 4 continues rotating. FIG. 1 shows the pincer elements 42 and 43 of the rotary cylinder 4 above the axle 19 in the gripping position and below the axle 19 in the open position.

The adjusting device shown in FIGS. 1, 1*a* and 3 which includes an eccentric effects a variation of the relative distance of the pressure elements 38 and 39 acting on the actuator elements 26, 27 and 28, 29, in consequence of which the actuating stroke of the actuator elements 26, 27 movable in opposed directions as indicated by the arrows $K_1$ and $K_2$ is equally varied. A longer actuating stroke of the actuator elements 26, 27 and 28, 29 results in a reduction of, while a shorter actuating stroke results in an increase in, the gripping force of the pincer elements 42, 43 movable towards each other.

FIGS. 5 to 7*b* illustrate schematically a variety of embodiments of adjusting devices equipped with an eccentric 10, in which in all embodiments the actuator element identified by B may be a single actuator element 27 provided with pincer elements as shown, for example, in FIGS. 9 or 12, or it may comprise two telescoping pairs of actuator elements 26, 27 and 28, 29 as shown in FIGS. 1 and 3. A pressure element 38 is rotatably mounted on the lateral arm 13 of the U-shaped bracket 22. Opposite this pressure element 38, the other lateral arm 21 of the U-shaped bracket 22 receives an adjusting device for the actuator element B and its pincer elements not shown in these Figures. To reduce operating noise and wear between the actuator element B and the pressure elements 38, 39, discs 63 may be inserted between the respective ends of the actuator element B and the pressure elements 38, 39, the latter acting on these in the course of rotation of the rotary cylinder 4 symbolized by the pincer elements 42, 43 of the epilating appliance.

Further, the stops 36 and 37 limit the relative distance of the actuator elements 26 and 27. In this manner, movement of the actuator elements commences invariably at the same location of rotation of the epilating cylinder, independently of the control of the pressure elements 38, 39, as soon as they are in contact with the pressure elements 38, 39 through the intermediary of the disc 63.

FIG. 5 shows an eccentric 10 equipped with an adjusting lever 100 and rotatably receiving the pressure element 39. The two pressure elements 38, 39 have a cylindrical surface. FIGS. 5*a* and 5*b* show clearly the maximum attainable adjusting stroke of the eccentric 10 on turning the adjusting lever 100 by 180 degrees in the direction of arrow E or F, it being understood that in practice an adjusting motion of the eccentric of the order of 60 degrees should be normally sufficient.

FIG. 6 shows an eccentric 10 equipped with an adjusting lever 100 and rotatably received on the lateral arm 21, the eccentric acting on the actuator element B indirectly through the disc 63 or, when the disc 63 is omitted, on the actuator element B direct.

FIG. 7 shows a section through an epilation head 3 having a U-shaped bracket 22 secured in its bearing shells 11 or 12, with an adjusting nut 105 equipped with an adjusting lever 100 being arranged on the lateral arm 21 of the bracket by means of a thread 102 provided on the lateral arm 21. A pressure element 39 having a conical surface 104 is associated with the adjusting nut 105. The end of the actuator element B is of a wedge-shaped configuration, the wedge being conformed to the conical surface 104 of the pressure element 39, as becomes apparent from FIGS. 7*a* and 7*b*. By turning the adjusting nut 105 on the thread 102, a variation of the relative distance of the pressure element 39 to the opposite pressure element 38 which is equally provided with a conical surface is effected through the associated beveled surfaces of the actuator element B and the pressure element 39, whereby a variation of the gripping force of the pincer elements not shown in these Figures is accomplished. Adjusting the pressure element 39 in the direction of the arrow M will result in an increased gripping force, whereas an adjustment in the opposite direction will reduce the gripping force.

FIGS. 8 to 8*b* illustrate a further embodiment of an adjusting device for the pincer elements of an epilating appliance 1. FIG. 8 shows an epilation head 3 of the rotary cylinder 4 configured in accordance with FIGS. 1 to 4. The rotary cylinder which is rotated by a driving gear 8 is rotatably mounted on the axle 19 disposed in the epilation head 3 by means of a bearing structure 24. The two lateral arms 13, 21 of the U-shaped bracket 22 have their respective ends bent at an outward angle. The angled end portions 131, 211 of the lateral arms are guided and held so as to be movable up and down within respective oblong bores 70, 71 provided in the respective bearing shells 11, 12. The angled end portions 131, 211 receive each a movable pressure element 38, 39 having a conical surface 72. At right angles to the direction in which the angled end portions 131, 211 extend is a respective recess 73, 74 provided in the respective bearing shell 11, 12 in which the pressure elements 38, 39 engage partially. The depth of the recesses 73, 74 is dimensioned such as to ensure a displacement of the pressure elements 38, 39 into the associated recess 73, 74 in accordance with the adjusting stroke of the vertically movable U-shaped bracket 22. The cone angle of the conical surface 72 of the pressure elements 38, 39 is equal to the angle of the angled end portions 131, 211 of the lateral arms. Accordingly, the surfaces 72 of the pressure elements 38, 39 extend parallel to the vertical extent of the lateral arms 13, 21, that is, at right angles to the axle 19 and parallel to the ends of the actuator elements 26, 27 and 28, 29 to which the pincer elements 42, 43 are fitted.

The epilation head 3 of FIG. 8 is split in its center for clarity of illustration of the effect of the components of the adjusting device acting on the bottom arm 221 of the bracket 22, which device will be explained in greater detail with reference to the schematic illustrations of FIGS. 8*a* and 8*b*. Extending parallel to the bottom arm 221, a bar 300 having a pivotal adjusting lever 100 projecting from the housing of the epilation head 3 is provided in the epilation head 3. The bar 300 preferably receives two eccentrics 10 acting on the bottom arm 221 of the bracket 22. The bottom arm 221 and thus the bracket 22 are moved in a vertical direction in and against the direction of the arrows N, $N_1$ by means of the eccentricity of the eccentric 10.

FIG. 8*a* and the right-hand part of FIG. 8 show the bracket 22 in tensioned position, since the full extent of the eccentricity of the eccentrics 10 acts on the bottom arm 221. As the vertical movement of the bracket 22 into the tensioned position proceeds, the angled end portions 131, 211 will slide upwards within the oblong bores 70, 71, their outwardly extending angle causing the pressure elements 38 and 39 to be moved in the direction of arrow P within the respective recesses 73, 74. Accordingly, the ,pressure elements 38, 39 experience a shift from the angled end portions 131, 211 inwardly in the direction of the actuator elements 26, 27. The distance between the pressure elements 38 and 39 in accordance with the predetermined eccentricity of the eccentric 10 becomes progressively smaller, resulting in a corresponding stepless variation of the gripping force of the pincer elements 42 provided on the actuator elements 26, 27.

When the eccentric of FIG. 8*a* is moved from the maximum gripping position shown into a minimum position as shown in FIG. 8*b* by turning the adjusting lever 100, the tensioned bracket 22 resting against the eccentric 10 will move in the direction of the arrow $N_1$. As this occurs, the pressure elements 38, 39 will slide on the angled end portions 131, 211 of the lateral arms which, owing to their outwardly extending angle, will urge the pressure elements into the interior of the respective recesses 73, 74, as shown on the left-hand side of FIG. 8. The pressure elements 38, 39 are thus at the extreme end of the angled end portions 131, 211. As a result, the distance between the pressure elements 38, 39 is at a maximum producing a corresponding minimum gripping force of the pincer elements 42, 43 provided on the actuator elements 26, 27. In FIG. 8*b*, the component f of the force $F_1$ of the counterforce to the gripping force of the pincer elements 42, 43 causes a displacement of the bracket 22 in the direction of arrow $N_1$ as a result of which the bracket is at all times in engagement with the eccentrics 10.

FIG. 9 shows a section through an epilation head 3 with an adjusting device of FIGS. 8 to 8*b* and a rotary cylinder 4, comprising an actuator element 26 rotatably mounted on the axle 19 and reciprocating in horizontal direction, the actuator element combining with associated pincer elements 42 to form a subassembly 261, and further comprising two additional actuator elements 27 extending through the pincer elements 42 and pivotally carrying further pincer elements 43. The actuator elements 26 and 27 are displaceable in opposed relation to each other against the pressure of springs 6. The actuator element 26 is provided with a driving gear 8 which sets the rotary cylinder 4 in rotation by means of the driving mechanism illustrated in FIG. 1. The two actuator elements 27 which are turned 180° from each other are arranged in the subassembly 261 of the rotary cylinder 4, their ends which project from the subassembly 261 moving into abutment with the pressure element 38 and 39, respectively, in the course of one revolution. Due to the predetermined relative distance of the pressure elements 38 and 39, the actuator elements 26, 27 upon which the respective pressure elements 38 and 39 act are moved against each other against the pressure of the respective spring 6, with the pivotally mounted pincer elements 43 engaging the pincer elements 42 fixedly mounted on the actuator element 26, thus performing a gripping action. The relative distance of the pressure elements 38 and 39 and consequently the gripping force of the pincer elements 42 and 43 is variable by means of the eccentrics 10 acting .on the bracket 22 in the manner described with reference to FIGS. 8 to 8*b*.

In the epilation head 3 of FIG. 9, the adjusting device described with reference to FIG. 10 which incorporates a bracket 22 fixedly mounted in the epilation head 3 may be substituted for the bracket 22 with its angled end portions 131 and 211 displaceable by means of eccentrics 10 as described with reference to and illustrated in the FIGS. 8 to 8*b*.

A further embodiment of an adjusting device is shown schematically in FIG. 10 and will be described in greater detail in the following. In the epilation head not shown, the bottom arm 221 of the U-shaped bracket 22 is secured by two support means 171, 181 as becomes apparent, for example, from the sectional view of FIG. 7. At the upper ends of the vertically extending lateral arms 131 and 211, a respective pressure element 38, 39 having a cylindrical surface is rotatably mounted. As the rotary cylinder 4 rotates about the axis 19, the respective ends of the actuator elements 26, 27 displaceable in opposed relation to each other against the pressure of a spring 6 will move into abutment with the pressure elements 38, 39. Preferably, discs 63 are provided between the ends of the actuator elements 26, 29 and the pressure elements 38, 39 in order to avoid impact noise produced by the cooperating parts. The pincer elements 42 and 43 are movably arranged within the grooves 41 and 33 as described with reference to FIGS. 2, 3 and 4. The adjusting device is arranged between the support means 171 and 181 and is comprised of an adjusting element, for example, an eccentric 10 with a lever 100. Such an adjusting element may be arranged in the epilation head 3 either below or above the bottom arm 221.

Depending on where the eccentric 10 is arranged, when an adjustment is made it will exert a pressure in the direction of either arrow $R_1$ or $R_2$. A pressure exerted on the bottom arm 221 in the direction of arrow $R_1$ will result in a reduced relative distance of the two lateral arms 131 and 211 and consequently in an increased gripping force of the pincer elements 42, 43 moved into relative engagement by the actuator elements 26 and 27. This pressure and thus the gripping force is infinitely variable by means of the predetermined eccentricity of the eccentric. The same effect is obtained in the reverse sense when the pressure on the bottom arm 221 acts in the direction of arrow $R_2$. In this event, the eccentric initially exerts a maximum pressure on the bottom arm 221, resulting in a correspondingly large relative distance of the two lateral arms 131 and 211 and a low gripping force between the pincer elements 42, 43. By adjusting the eccentric so that the pressure acting on the bottom arm 221 decreases in the direction of arrow $R_2$, the lateral arms 131, 221 will perform a corresponding movement towards each other, as a result of which the gripping force of the cooperating pincer elements 42, 43 will be increased correspondingly.

FIG. 11 shows a further embodiment of an adjusting device for pincer elements 42, 43 arranged on two actuator elements 26, 27 movable against each other in opposition to the pressure of a spring 6. The actuator elements 26, 27 are displaceably mounted on a bearing structure 24 rotatably carried on the axle 19—see FIG. 1—and are acted upon by pressure elements 38, 39. At the ends of the actuator elements 26, 27 facing each other, respective stops 500, 501 are provided for the adjusting device. The adjusting device is comprised of two brackets 506, 507 rotatably received in respective bearing means 502, 503 and 504, 505 of the epilation head 3 and having two pairs of angled arms 508, 509 and 510, 511. At the ends of the first pair of bracket arms 508 and 509 close to the stops 500, 501, respective rollers 512, 513 are mounted rotatably. A respective disc 63 is inserted between the rollers 512, 513 and the adjacent stops 500, 501. Between the ends of the second pair of bracket arms 510, 511 carried in the bearing means 503, 505, a cam 514 configured as a double eccentric is rotatably mounted—see top plan view of FIG. 11*a*. The cam is adjustable by means of an adjusting screw, not shown, which is passed through the epilation head. Rotation of the cam 514 and the resulting action of its curved contour causes the second pair of bracket arms 510, 511 to be spread apart a corresponding amount.

On account of the rotatable mounting of the two brackets 506, 507, the arms 508 and 509 of the first pair of brackets perform an analogous spreading movement, transmitting it through the rollers 512 and 513 to the stops 500 and 501 of the actuator elements 26, 27. By means of the curved contour of the cam 514, the relative distance of the actuator elements 26, 27 between their respective stops 500, 501 is variable, and accordingly also the relative distance of the pincer elements 42, 43 disposed on the actuator elements 26, 27. The gripping force of the pincer elements 42, 43 is thus suitably variable, that is, adjustable, by changing the distance through the cam 514.

FIG. 12 shows the epilation head 3 of an epilating appliance 1 whose rotary cylinder 4 is comprised of a component 261 rotatably mounted in the epilation head 3 and including pincer elements 42 fixedly disposed thereon and movable pincer elements 43 operatively associated therewith. The movable pincer elements 43 are coupled to an actuator element 27 extending through the pincer elements 42 of the component 261 and are pivotally carried in bearing means provided on the component 261. For holding and guiding the actuator element within the rotary cylinder 4, a bar 601 passed through the pincer elements 42 and 43 is associated therewith. At the end close to the pressure element 39, the actuator element 27 and the bar 601 are received within an opening of a guide element 602 and are connected to form a unit by means of a pin 603 extending through the actuator element 27, the bar 601 and the guide element 602. The guide element 602 having its end 604 in abutment with the pressure element 39 is horizontally movably carried in the end plate 605 of the rotary component 261. The end of the actuator element 27 remote from the pressure element 39 is horizontally movable against the pressure of a spring within an opening 607 provided in the end plate 606 of the component 261. In order to operate the pincer elements 42 and 43 twice per revolution of the rotary cylinder 4, a second actuator element 28 is suitably arranged and configured in the component 261, being turned at an angle of 180 degrees from the actuator element 27 previously described. Because this second actuator element 28 is not in abutment with the pressure element 39, the spring is in untensioned condition. As a result, the movable pincer elements 43 will occupy a predetermined relative distance to the pincer elements 42 which is necessary for capturing the hair for extraction. The component 261 of the rotary cylinder 4 is arranged in the epilation head 3 intermediate two bearing blocks 608, 609, of which only the bearing block 609 is shown completely for clarity of illustration, within which it is journaled for rotary movement. The component 261 is driven to rotate by the driving gear 8 and a drive mechanism located in the casing. The pressure element 39 is rotatably mounted on an eccentric 10 configured according to FIG. 1*a*. The eccentric 10 provided with an adjusting lever 100 is rotatably mounted on a bar 222 fixedly disposed in the epilation head. By turning the adjusting lever 100, the eccentric 10 transmits its eccentricity via the pressure element 39 to the actuator element 27 and 28, effecting a corresponding variation of the relative distance of the pressure element 39 to the opposed support of the actuator element 27 and 28 in the end plate 606 of the component 261. This variation of the distance results in a variation of the gripping force between the pincer elements 42 and 43.

The individual ways of operation of the eccentrics 10, 210 at a minimum and a maximum setting of the gripping force will be described in the following with reference to FIGS. 13 to 16. In all Figures, the actuator element designated by B covers the actuator elements 26, 27 and 28, 29 displaceable against each other in pairs.

FIGS. 13 and 14 illustrate the position in which the pincer elements 42, 43 (FIG. 1), which are not shown in these schematic representations, are open. The lateral arms 13, 21 of the bracket 22 are in engagement with the slots 20 of the axle 19 and urge against the axle ends providing the abutments 80, 81 for the lateral arms 13, 21. The distance between the lateral arms 13, 21 corresponds to the length of the axle 19. In FIG. 13, the eccentric 10 has its small radius r, and in FIG. 14 its large radius R, on the side close to the abutment 80. These positions illustrate the minimum and, respectively, maximum adjusting stroke of the eccentric, which corresponds to the minimum and, respectively, maximum setting of the gripping force. Because the eccentric 10 does not act on the axle 19, the bias of the bracket 22 remains unchanged.

The representations of FIGS. 13*a* and 14*a* correspond to the closed position of the pincer elements 42, 43.

In FIG. 13*a*, the actuator element B is in contact with the pressure elements 38, 39, with the bracket 22 being spread only slightly because of the small adjusting stroke of the eccentric 10. The distances G and G' thereby occurring between the lateral arms 13, 21 and the respective abutments 81, 80 will approximate each other as a result of an automatic centering during operation of the appliance. The distance between the lateral arms 13, 21 at the elevation of the abutments 80, 81 will assume the value L1.

In the gripping position and with the gripping force at its maximum, the eccentric disc 10 acts with its large radius R through the pressure element 39 onto the actuator element B, FIG. 14*a*. The bracket 22 will be spread by the maximum adjusting stroke of the eccentric 10 such as to form nearly right angles with its lateral arms 13, 21. The resulting distance G, G' between the abutments 80, 81 and the lateral arms 13, 21 is substantially greater than when the gripping force is at a minimum setting. The relative distance of the lateral arms 13, 21 at the elevation of the abutments 80, 81 will be increased to L2. As becomes apparent from a comparison between the FIGS. 13*b* and 14*b*, this will necessarily vary the distance traveled by the actuator element B in contact with the pressure element 39 under the action of the gripping force.

FIG. 13*b* shows on an enlarged scale a top plan view of the pressure element 39 with the eccentric 10 and the adjusting lever 100 as well as the actuator element B. The lateral arm 21 rests against the axle 19. The section between the position X in which the actuator element B is in contact with the pressure element 39 and the position Y in which the contact ceases corresponds to the length of travel under the action of the gripping force. With the gripping force at its minimum setting, that is, with the eccentric performing a minimum adjusting stroke, this travel is short.

In the arrangement of FIG. 14*b*, the maximum possible adjusting stroke corresponding to the maximum setting of the gripping force is attained by turning the eccentric 10 by 180 degrees using the adjusting lever 100. With its large radius R, the eccentric 10 is on the side close to the actuator element B. As a result, the actuator element B will contact the pressure element 39 earlier, the contact also ceasing later. The travel resulting therefrom for the actuator element B under the impact of a maximum force will become longer a corresponding amount, resulting in higher power requirements for the appliance. Such different power requirements which are dependent on whether the gripping force is at a minimum or a maximum setting are disadvantageous for the appliance, in particular when it is battery-powered. Accordingly, a reduction of the requisite power at a maximum setting of the gripping force could be accomplished by shortening the length of travel covered by the actuator element B and the pressure element 39 when in mutual contact.

As appears from FIGS. 15 and 16, the arrangement discussed thus far is modified by adding another eccentric 210. With regard to its eccentricity, this eccentric 210 is arranged on the lateral arm 21 of the bracket in the same manner as the eccentric 10, forming an extension of the eccentric 10. Already in the open position of the pincer elements according to FIG. 15, this eccentric 210 acts with its narrow dimension s through the lateral arm 21 of the bracket 22 directly upon the abutment 80. The axle 219 is shorter than the axle 19 by the amount s, whereby the bias of the bracket 22 remains unchanged.

When the pressure elements 38, 39 and the actuator element B move into contact with each other as shown in FIG. 15*a*, the bracket 22 will be spread as in the arrangement of FIG. 13*a*. In the presence of a minimum gripping force, the distance L1 occurring between the lateral arms 13, 21 and the abutments 80, 81 will correspond to the distance L1 in FIG. 13*a*, which is due to the exclusive action of the small radius r of the eccentric 10.

FIG. 16 shows an arrangement in which the adjusting stroke is at its maximum, that is, in which the eccentric 210 has its broad dimension S on the side close to the abutment 80. The eccentric 210 thereby causes the bracket 22 to be spread by the amount S. The bias of the bracket 22 is thus substantially increased as compared with the arrangement in which only one eccentric 10 is provided (FIG. 14).

In FIG. 16*a*, the actuator element B is in contact with the pressure elements 38, 39, that is, the pincer elements 42, 43 are in gripping position. The eccentric 10 acts through its large radius R, causing the gripping force to be at its maximum. The distance L2 between the lateral arms 13, 21 corresponds to the distance L2 of FIG. 14*a*. Because the eccentric 210 acts on the axle end through its portion S already in the open position, causing the bracket 22 to be spread, the additional spread required from the bracket 22 in the gripping position is substantially smaller than in the arrangement of FIG. 14*a*. Accordingly, the distance to be traveled by the actuator element in contact with the pressure element is reduced, corresponding approximately to the distance to be traveled when the gripping force is at a minimum setting.

The approximation of the distance to be traveled jointly between the actuator element B and the pressure element 39 at a maximum setting of the gripping force to the distance to be traveled at a minimum setting of the gripping force by providing the eccentric 210 becomes apparent from the representations of FIGS. 15*b* and 16*b*. With the gripping force at a minimum setting, the eccentric 210 has its narrow dimension s between the lateral arm 21 and the axle 219. The distance to be traveled between the positions X and Y is short because of the small difference between the bias of the bracket 22 and the gripping position.

When dimension S of the eccentric 210 between the axle 219 and the lateral arm 21 becomes effective, which is accomplished by turning the eccentric 210 through 180 degrees to its maximum possible adjusting stroke, that is, the maximum gripping force, the bracket 22 will be spread by this amount S. The axle 219 will be moved into abutment with the eccentric 210. In the gripping position, the cooperation of actuator element B and pressure element 39, results in further spreading of the bracket 22. The lateral arms 13, 21 of the bracket 22 will become detached from the axle 219, the distance then resulting between the axle 219 and the lateral arms 13, 21 being small. Due to the abutment of the axle 219 with the eccentric 210 in the non-gripping position, the distance to be traveled by the actuator element B and the pressure element 39 during the gripping cycle is approximately equal to the distance at a minimum setting of the gripping force. In consequence, the arrangement of a second eccentric enables the higher power requirements to be reduced significantly when the appliance is operated at a maximum setting of the gripping force.

We claim:

1. An epilating appliance for the removal of human body hair comprising casing structure adapted to be held in the user's hand, a motor in said casing structure, spring structure in said casing structure, rotary cylinder structure carried by said casing structure and driven by said motor, said cylinder structure including a plurality of pincer elements, at least one actuator element extending through said rotary cylinder structure for actuating said pincer elements, at least one pressure element associated with said actuator element, said actuator element being operable by said associated pressure element and being displaceable against the pressure of said spring structure for actuating said pincer elements, and structure for adjusting the gripping force of said pincer elements.

2. The epilating appliance of claim 1 and further including structure for varying the position of said actuator element.

3. The epilating appliance of claim 1 wherein said appliance includes a plurality of actuator elements, said actuator elements cooperate in pairs and further including structure for varying the relative positions of said pairs of said actuator elements.

4. The epilating appliance of claim 1 wherein said pressure element and said actuator element have respective contact surfaces that act upon each other, and said contact surfaces are arranged so as to extend in wedge shape to each other.

5. The epilating appliance of claim 1 and further including disc structure between said pressure element and said actuator element.

6. The epilating appliance of claim 5 and further including bar structure disposed in said casing structure, said pressure element being arranged on said bar structure.

7. The epilating appliance of claim 6 wherein said bar structure is formed of a pin.

8. The epilating appliance of claim 6 wherein said bar structure is configured as a U-shaped bracket.

9. The epilating appliance of claim 8 wherein said bracket has two lateral arms with angled ends that extend in the same plane relative to the outside of the appliance.

10. The epilating appliance of claim 8 wherein said bracket has two lateral arms, said pressure element is arranged on one of said lateral arms, and adjusting nut structure is arranged on the other one of said lateral arms for adjusting the position of a second said pressure element.

11. The epilating appliance of claim 1 wherein said adjusting structure includes adjusting nut structure acting on said pressure element for adjusting the position of said pressure element relative to said actuator element.

12. The epilating appliance of claim 11 wherein said pressure element and said actuator element have respective contact surfaces that act upon each other, and said contact surfaces are arranged so as to extend in wedge shape to each other.

13. The epilating appliance of claim 1 and further including U-shaped bracket structure in said casing structure, said bracket structure including two lateral arms and a bottom arm connecting said lateral arms, and wherein a said pressure element is arranged on each of said two lateral arms.

14. The epilating appliance of claim 13 and further including support structure in said casing structure for holding said bottom arm generally parallel to the axis of rotation of said cylinder structure, and wherein said means for adjusting the gripping force includes an adjusting element that disposed intermediate said lateral arms and that acts on said bottom arm for moving said bracket structure relative to said support structure.

15. The epilating appliance of claim 14 wherein said adjusting element is an eccentric and is mounted in said casing structure.

16. The epilating appliance of claim 13 wherein said adjusting structure includes eccentric structure mounted on said casing structure.

17. The epilating appliance of claim 16 and further including abutment structure associated with said lateral arms of said bracket structure, and a further adjusting device for varying the position of said lateral arms relative to said abutment structure.

18. The epilating appliance of claim 17 wherein said further adjusting device includes an adjustable eccentric structure.

19. The epilating appliance of claim 18 wherein said adjustable eccentric structure is coupled to said eccentric structure.

20. The epilating appliance of claim 19 wherein said adjustable eccentric structure and said eccentric structure are integrally made of one piece.

21. The epilating appliance of claim 13 wherein said bracket structure is displaceably mounted in said casing structure, said pressure element is arranged to be slidable in a reciprocating fashion within a respective recess provided in said casing structure in the direction (P) of an axis extending transversely to the direction in which said lateral arms extend, and at least one adjusting element is provided on said bottom arm for effecting displacement of said bracket structure.

22. The epilating appliance of claim 21 wherein a said lateral arm has an angled end, said pressure element is arranged on said angled end of said lateral arm, and said pressure element has an axis that extends at right angles to the direction in which the angled arm extends.

23. The epilating appliance of claim 1 and further including U-shaped bracket structure in said casing structure, said bracket structure including two lateral arms and a bottom arm connecting said lateral arms, and wherein a said pressure element is arranged on each of said two lateral arms, said structure for adjusting the gripping force acts on said bottom arm, and said rotary cylinder structure includes at least two actuator elements arranged to be displaceable in opposed directions against the pressure of said spring structure, axle structure extends through said rotary cylinder structure, bearing structure is rotatably mounted on said axle structure, said actuator elements are slidably disposed on said bearing structure, said pincer elements are coupled to said actuator elements, and the respective ends of said actuator elements are adapted to be acted upon by said pressure elements disposed on said lateral arms.

24. The epilating appliance of claim 23 wherein the ends of said axle structure are each provided with a slotted opening that detachably receives a said lateral arm of said U-shaped bracket structure.

25. The epilating appliance of claim 23 wherein said pincer elements are adapted to be moved into engagement with each other in pairs by means of said actuator elements displaceable in opposed directions, said pincer elements being pivotally coupled to said actuator elements.

26. The epilating appliance of claim 23 wherein said pincer elements are adapted to be moved into engagement with each other in pairs by means of said actuator elements displaceable in opposed directions, one actuator element with a plurality of associated pincer elements forming a subassembly and the other actuator element has associated pincer elements pivotally coupled thereto, and said subassembly is arranged so as to be rotatable and horizontally movable on said axle structure.

27. The epilating appliance of claim 1 wherein said rotary cylinder structure includes a component mounted in said casing structure, said plurality of pincer elements comprising a first plurality of said pincer elements fixedly disposed on said component and a second plurality of movable pincer elements operatively associated with said plurality of first pincer elements, said actuator element further comprising movable actuator element structure extending through said first pincer elements, said movable pincer elements being coupled to said movable actuator element structure said pressure element being adjustable relative to said movable actuator element structure, said movable actuator element structure being acted upon by said adjustable pressure element.

28. The epilating appliance of claim 1 and further including axle structure that extends through said rotary cylinder structure, and bearing structure rotatably mounted on said axle structure, and wherein two actuator elements displaceable in opposed directions against the pressure of said spring structure are provided on said bearing structure, and further including stop structure on said actuator elements at their respective ends facing each other for adjusting said actuator elements.

29. The epilating appliance of claim 28 and further including means for adjusting said actuator elements comprising two bracket structures rotatably mounted in said casing structure for rotation with said cylinder structure, each said bracket structure including a first bracket arm and a second bracket arm, a roller arranged on each said first bracket arm for abutment with said stop structure, and cam structure acting on each said second bracket arm, said actuator elements being each displaceable by an associated pressure element in opposition to the pressure of said spring structure.

30. The epilating appliance of claim 29 and further including a respective disc between each said roller and said stop structure.

31. An epilating appliance for the removal of human body hair comprising casing structure adapted to be held in the user's hand, a motor in said casing structure, rotary cylinder structure carried by said casing structure and driven by said motor, said cylinder structure including a plurality of pincer elements, spring structure in said casing structure, at least one actuator element extending through said rotary cylinder structure for actuating said pincer elements, at least one pressure element associated with said actuator element, said actuator element being operable by said associated pressure element and being displaceable against the pressure of said spring structure, and adjustable eccentric structure for adjusting the gripping force of said pincer elements.

32. The epilating appliance of claim 31 wherein said pressure element is configured as a roller and is rotatably mounted on said eccentric structure.

33. The epilating appliance of claim 32 and further including disc structure between said pressure element and said actuator element.

34. The epilating appliance of claim 32 and further including U-shaped bracket structure in said casing structure, said bracket structure including two lateral arms and a bottom arm connecting said lateral arms, and wherein a said pressure element is arranged on each of said two lateral arms, said structure for adjusting the gripping force acts on said bottom arm, and said rotary cylinder structure includes at least two actuator elements arranged to be displaceable in opposed directions against the pressure of said spring structure, axle structure extends through said rotary cylinder structure, bearing structure is rotatably mounted on said axle structure, said actuator elements are slidably disposed on said bearing structure, said pincer elements are coupled to said actuator elements, and the respective ends of said actuator elements are adapted to be acted upon by said pressure elements disposed on said lateral arms.

35. The epilating appliance of claim 34 and further including support structure in said casing structure for holding said bottom arm generally parallel to the axis of rotation of said cylinder structure, and wherein said means for adjusting the gripping force includes an adjusting element disposed intermediate said lateral arms and that acts on said bottom arm for moving said bracket structure relative to said support structure.

36. The epilating appliance of claim 34 wherein said bracket structure is displaceably mounted in said casing structure, at least one of said said pressure elements is arranged to be slidable in a reciprocating fashion within a respective recess provided in said casing structure in the direction (P) of an axis extending transversely to the direction in which said lateral arms extend, and at least one adjusting element is provided on said bottom arm for effecting displacement of said bracket structure.

37. The epilating appliance of claim 36 wherein at least one said lateral arms has an angled end, one said pressure element is arranged on said angled end of said lateral arm, and said pressure element has an axis that extends at right angles to the direction in which its angled arm extends.

38. The epilating appliance of claim 34 and further including means for adjusting said actuator elements comprising two bracket structures rotatably mounted in said casing structure for rotation with said cylinder structure, each said bracket structure including a first bracket arm and a second bracket arm, a roller arranged on each said first bracket arm for abutment with said stop structure, and rotary cam structure acting on each said second bracket arm, said actuator elements being each displaceable by an associated pressure element in opposition to the pressure of said spring structure.

* * * * *

UNITED STATES PATENT AND TRADEMARK OFFICE

CERTIFICATE OF CORRECTION

PATENT NO. : 5,494,485

DATED : February 27, 1996

INVENTOR(S) : Georges Gabion et al.

It is certified that error appears in the above-identified patent and that said Letters Patent is hereby corrected as shown below:

On the title page, item [30], add
Foreign Priority Information:

France 91/10695 08/28/91

Signed and Sealed this

Twenty-eighth Day of May, 1996

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,494,485

DATED : February 27, 1996

INVENTOR(S) : Georges Gabion et al.

It is certified that error appears in the above-identified patent and that said Letters Patent is hereby corrected as shown below:

Col. 1, before the first paragraph, please insert the following new paragraph:

--This is a continuation application of International Application No. PCT/EP92/01909, with an international filing date of August 20, 1992, now abandoned.--

Col. 2, line 18, "wearrelated" should be --wear-related--.

Col. 6, line 28, after "of" delete the comma.

Col. 9, line 9, after "the" delete the comma.

Col. 14, line 8, after "39" delete the comma.

Col. 18, claim 36, line 6, "said said" should be --said--.

Signed and Sealed this

Eighth Day of October, 1996

Bruce Lehman

*Attest:*

BRUCE LEHMAN

*Attesting Officer*

*Commissioner of Patents and Trademarks*